US005949006A

United States Patent [19]

Hechler

[11] Patent Number: 5,949,006

[45] Date of Patent: Sep. 7, 1999

[54] STRINGED MUSICAL INSTRUMENT OF SIMPLIFIED CONSTRUCTION

[76] Inventor: Matthew John Hechler, 120 Dekalb Dr. SW., Apt. 6/C, Rainsville, Ala. 35986

[21] Appl. No.: 09/024,272

[22] Filed: Feb. 17, 1998

[51] Int. Cl.[6] ..... G10D 1/00; G10D 1/08

[52] U.S. Cl. ..... 84/291; 84/267; 84/290

[58] Field of Search ..... 84/267–269, 274–275, 84/290–291

[56] References Cited

U.S. PATENT DOCUMENTS

| | | | |
|---|---|---|---|
| D. 44,162 | 6/1913 | Bateman . | |
| D. 52,539 | 10/1918 | McVey . | |
| D. 70,509 | 7/1926 | Peroutek . | |
| D. 188,349 | 7/1960 | Cole et al. | D56/1 |
| D. 205,601 | 8/1966 | Swagerty . | |
| D. 281,075 | 10/1985 | Stolhand . | |
| D. 305,546 | 1/1990 | Roberts . | |
| 1,183,369 | 5/1916 | Gardie . | |
| 1,489,710 | 4/1924 | Olsen . | |
| 2,031,706 | 2/1936 | Hambrecht et al. | 84/294 |
| 2,473,980 | 6/1949 | Willner . | |
| 2,498,926 | 2/1950 | Mitchell | 84/267 |
| 2,523,963 | 9/1950 | Mitchell | 84/267 |
| 2,953,052 | 9/1960 | Newton | 84/1.16 |
| 3,561,314 | 2/1971 | MacEachron . | |
| 3,774,492 | 11/1973 | Forbes . | |
| 4,241,637 | 12/1980 | Brent . | |
| 4,320,685 | 3/1982 | Pytlewski . | |
| 4,411,186 | 10/1983 | Faivre . | |
| 4,606,255 | 8/1986 | Hayashi et al. . | |
| 4,712,463 | 12/1987 | Kubicki et al. . | |
| 4,873,909 | 10/1989 | Humphrey . | |
| 5,461,958 | 10/1995 | Dresdner et al. | 84/267 |

*Primary Examiner*—William M. Shoop, Jr.
*Assistant Examiner*—Marlon T. Fletcher
*Attorney, Agent, or Firm*—Chambliss Bahner & Stophel, P.C.

[57] ABSTRACT

A musical instrument is comprised of a hollow sound box having a sound board with a first opening and a second opening, and an elongate neck that is attached to the sound board. The sound box is preferably formed out of substantially flat, trapezoidal components, and the neck is attached to the sound board in overlapping fashion. The neck has a string attachment for attachment of one or more strings, and a bridge is attached to the sound board between the neck and the first sound opening. The bridge has a top edge with at least one groove defined therein to receive at least one string. At least one tuning key is attached to the outside surface of the sound board adjacent to the first sound opening and extending through the sound board to the inside of the sound box. One end of each string is attached to the string attachment on the neck, and the other end is attached to one of the tuning keys inside the sound box. The instrument may also be provided with adjustable feet on its bottom, an adjustable neck and an adjustable bridge.

20 Claims, 6 Drawing Sheets

STRINGED MUSICAL INSTRUMENT OF SIMPLIFIED CONSTRUCTION

FIELD OF THE INVENTION

This invention relates generally to musical instruments, and more particularly to the larger acoustic stringed instruments of the violin family, such as the cello and the bass.

BACKGROUND AND DESCRIPTION OF THE PRIOR ART

In the violin family of stringed instruments, there are many varieties, including (in order of size) the violin, viola, cello (also called the violincello) and bass (also called the bass viol, contrabass or double bass). Among the cellos and basses can be found instruments of several sizes. Thus, for example, basses may range in size from small electric bass guitars having a 28-inch scale to large "stand-up" contrabasses.

Generally, the smaller the instrument within the violin family, the higher it is pitched. This is because the smaller instruments have smaller sound boxes adjacent their vibrating strings. Thus, the violins generally produce the highest-pitched musical tones and the basses generally produce the lowest. Furthermore, among the differently sized basses, the instruments with the larger sound boxes typically produce lower-pitched or deeper bass notes. Thus, the contrabasses with the largest sound boxes will produce the lowest-pitched and deepest bass sounds.

Unfortunately, however, the larger the sound box on an instrument, the larger and more cumbersome the instrument is to handle. One disadvantage of these large cumbersome instruments is that they are difficult to transport, carry and store. In addition, all members of the violin family are difficult and expensive to manufacture, because they are comprised of numerous curved surfaces that are usually made of wood, which requires special manufacturing that involves much skilled labor. Another disadvantage of the size of the bass instrument is that it is typically more than six feet long, with a 41-inch scale. Such an instrument is difficult for smaller musicians to play because of the long arm-span and finger-spread required to reach the frets and tuning pegs, and because the instrument must generally be balanced on a single support while being played.

Several attempts have been made to develop a "stand-up" type instrument that is self-supporting in the playing position. One such instrument is shown in U.S. Design Pat. No. 281,075 of Stolhand. The Stolhand instrument has the appearance of a large guitar of generally conventional configuration, although it also includes a pair of leg assemblies that are adapted to hold the instrument in an upright position for playing. Because the shape of its sound box is conventional, its manufacture would be just as complex as that of a conventional bass, or even more complex because of the addition of the leg assemblies.

Another "stand-up" type stringed instrument is described in U.S. Pat. No. 3,774,492 of Forbes, which is formed from an empty five-gallon gasoline can and an upstanding neck component. The can is of the type used to carry gasoline on vehicles, and as used in the construction of the instrument, is disposed with one of its larger sides forming the base. Although the Forbes instrument would probably be somewhat easier to manufacture than a conventional bass, it is doubtful that its gasoline-can sound box would be capable of creating musical notes that would compare with those produced by a conventional bass.

It is also known that a dulcimer may be provided in a shape that is conducive to relatively economical construction. Such an instrument is described in U.S. Pat. No. 3,561,314 of MacEachron, which is designed to be constructed of wood that may be formed with all straight saw cuts. However, a dulcimer is designed to lay flat on the musician's lap while being played, and its arrangement of neck, fingerboard, strings and sound box are not comparable to that of a conventional bass. Consequently, it produces unique sound s that are not comparable to those produced by a conventional bass.

It would be desirable, therefore, if a more compact bass could be developed that would be capable of producing musical notes comparable to those produced by a conventional bass. It would also be desirable if such an instrument could be developed that would be easier for musicians of small stature to play, and that would be easier to carry, transport and store. It would also be desirable if such an instrument could be developed that would be relatively inexpensive to manufacture.

OBJECTS AND ADVANTAGES OF THE INVENTION

Accordingly, it is an object of the invention claimed herein to provide a bass instrument that is more compact than existing bass instruments with comparable tonal qualities. It is another object of this invention to provide a bass instrument that is easier and more economical to manufacture than conventional bass instruments. Another object of the invention is to provide a bass instrument having a sound box that may be constructed of substantially flat component pieces. It is yet another object of this invention to provide a bass instrument that is more comfortable to play than existing bass instruments. Still another object of the invention is to provide such an instrument that is self-supporting or free-standing in the playing position. Another object of the invention is to provide such an instrument the sound of which may be easily amplified.

Other objects, features and advantages of the invention will become apparent upon reading the following detailed description of the preferred embodiments thereof, when taken in conjunction with the accompanying drawings and the appended claims.

SUMMARY OF THE INVENTION

The invention is a musical stringed instrument of the acoustic type which includes a hollow sound box. The sound box is comprised of a number of components, including a sound board with a first opening and a second opening, a first side board attached to the sound board, a second side board attached to the sound board and disposed in a spaced relationship with the first side board, a back board connected to the first and second side boards, and a bottom board connected to the sound board, first side board, second side board, and back board. The instrument also includes an elongate neck that is attached to the sound board, said neck having a string attachment thereon for attachment of one or more strings, and a bridge attached to the sound board between the neck and the first sound opening. The bridge has a top edge with at least one groove defined therein. At least one tuning key is also provided which is attached to the outside surface of the sound board adjacent to the first sound opening and extending through the sound board to the inside of the sound box. The instrument also includes at least one string, the first end of which is attached to the string attachment and the second end of which is attached to the tuning key inside the sound box, so that said string extends across the bridge and is disposed inside a groove on the bridge.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
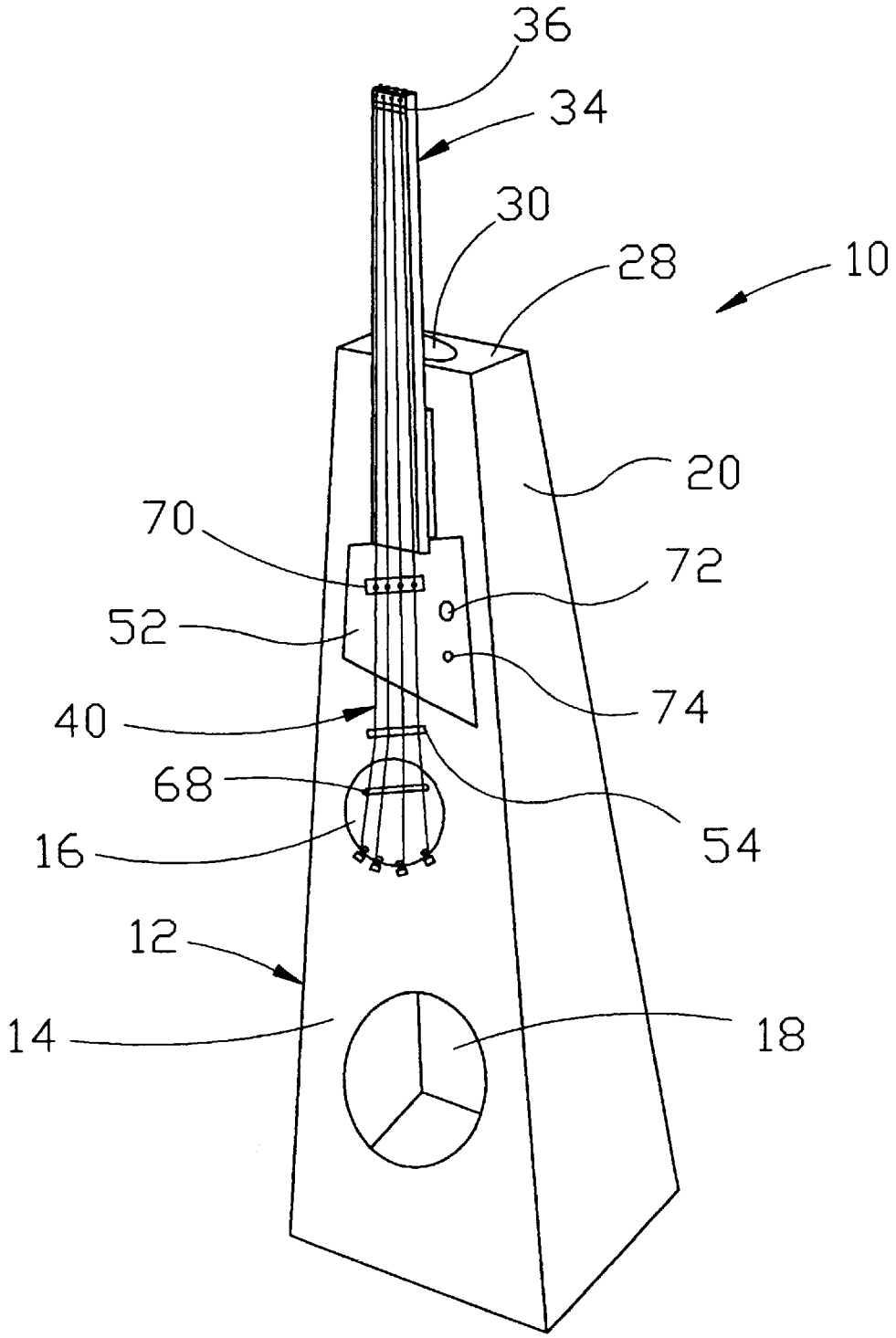
FIG. 1 is a perspective view of a preferred embodiment of the invention.

Referring now to the drawings, the preferred embodiment 10 of the invention is an acoustic stringed bass instrument that is free standing and has a sound box constructed of substantially flat component pieces. As illustrated in FIG. 1, instrument 10 includes a hollow sound box 12, one component of which is comprised of sound board 14 having first opening 16 and second opening 18. The overall shape of the sound board is preferably trapezoidal, although a rectangular or other convenient shape could be employed. First opening 16 is preferably elliptical in shape, and second opening 18 is preferably substantially circular, although the openings may be provided in any convenient shape.

Figure 2:
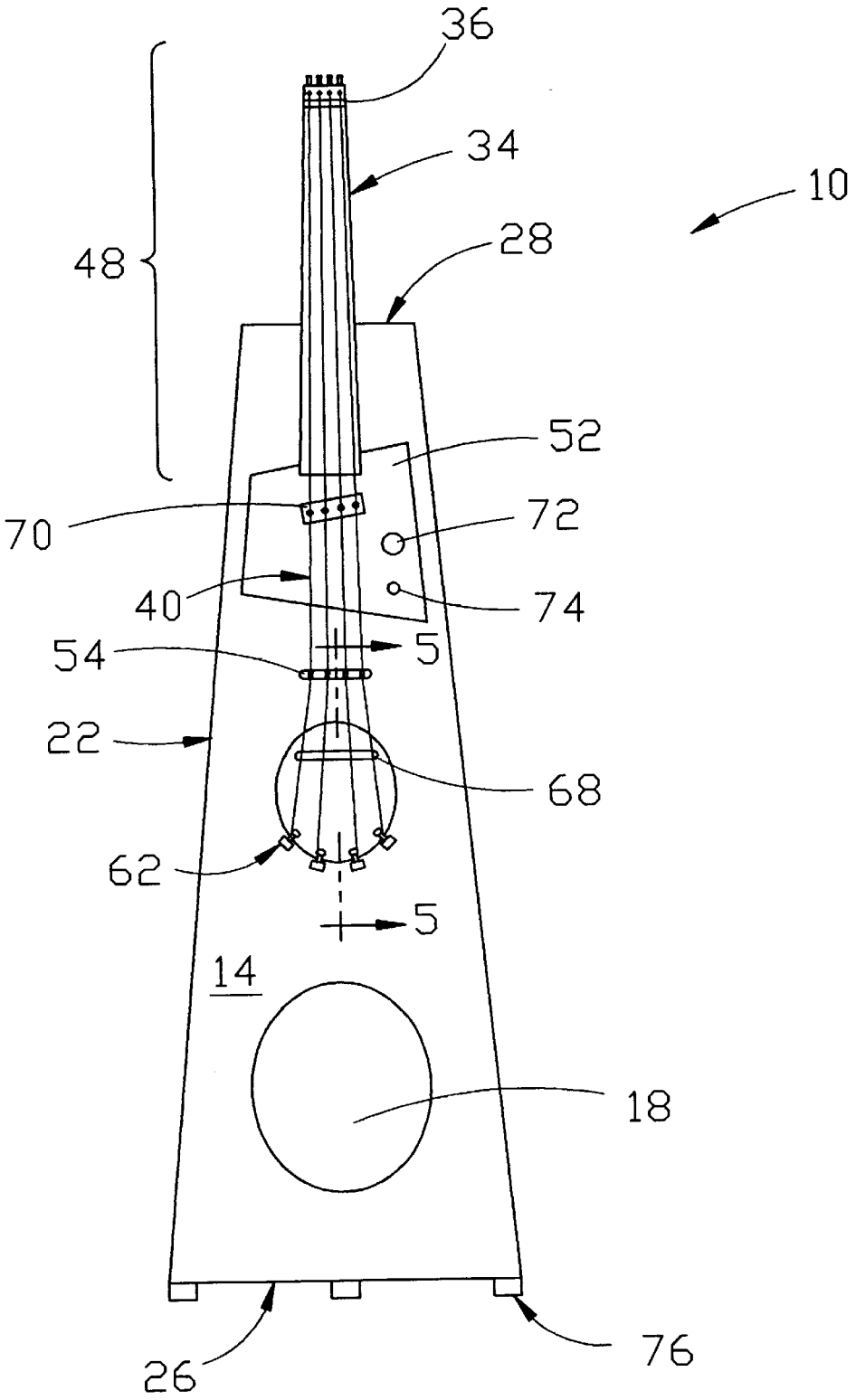
FIG. 2 is a front elevation view of the embodiment of FIG. 1.
Figure 3:
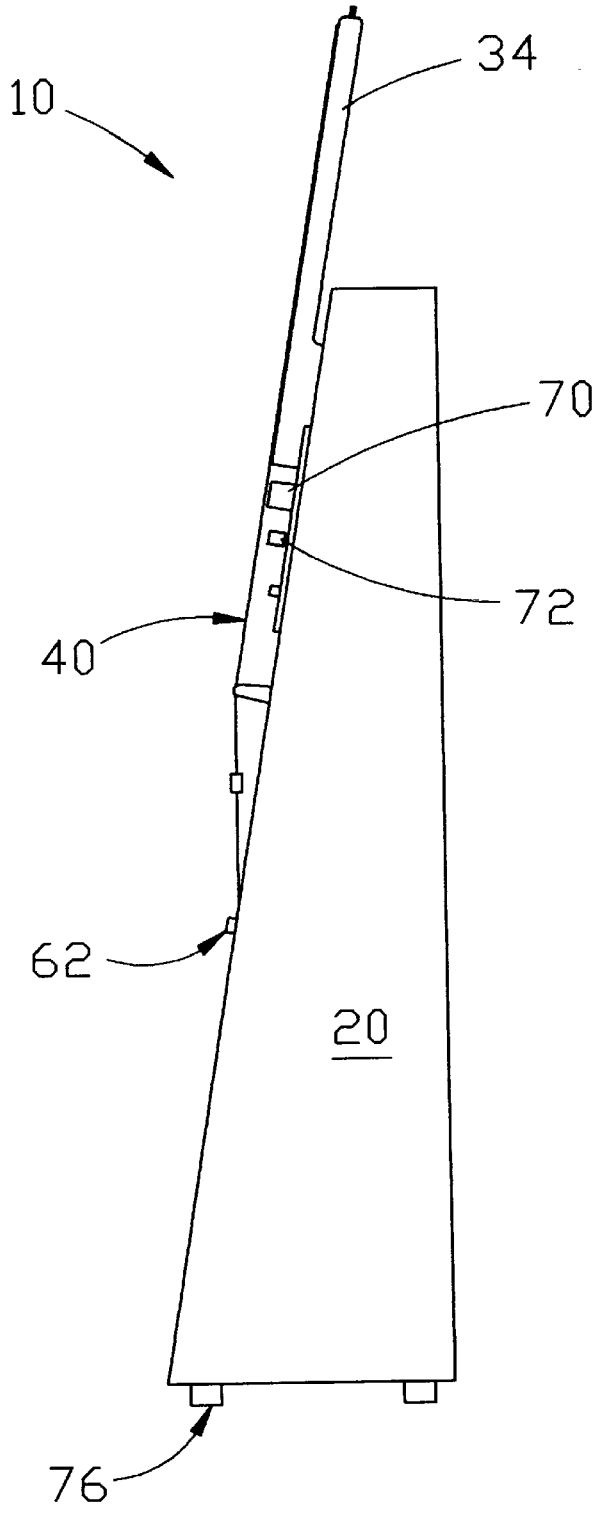
FIG. 3 is a side elevation view of the embodiment of FIG. 1.
Figure 4:
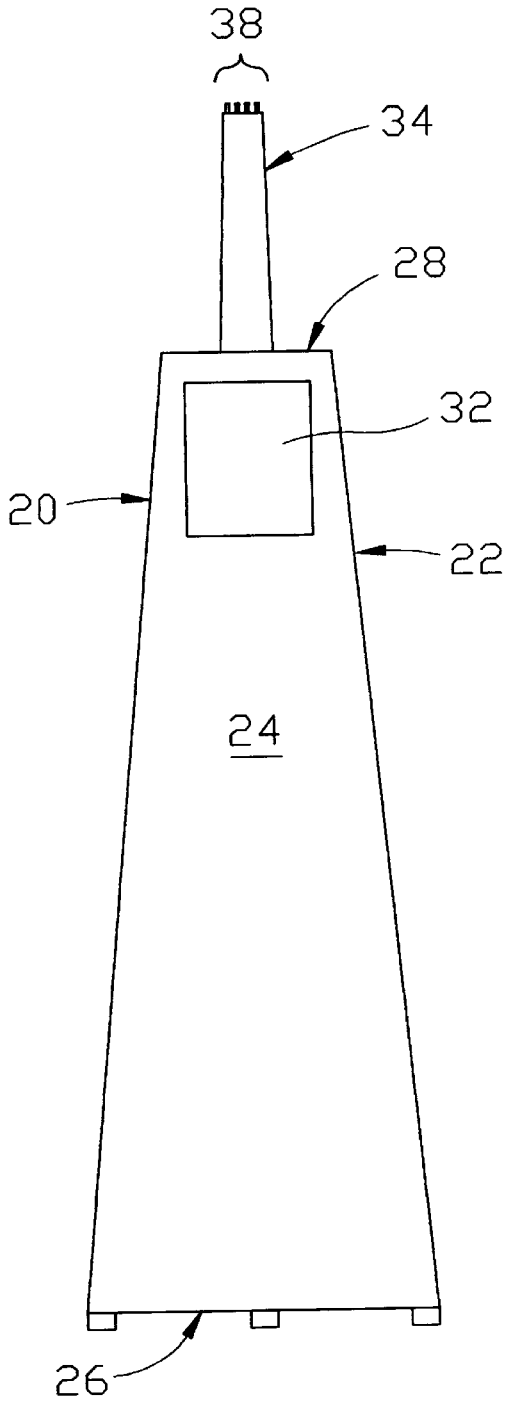
FIG. 4 is a rear elevation view of the embodiment of FIG. 1.

First side board 20 and second side board 22 (see FIG. 2) are attached at opposite sides of the sound board so as to be disposed in a spaced relationship with each other to partially enclose sound box 12. Back board 24 (shown in FIG. 4) is connected to the first and second side boards. These components, like the sound board, are preferably substantially flat and trapezoidal in shape, although they could be rectangular or of another convenient shape.

Bottom board 26, which is preferably substantially flat and rectangular in shape, connects sound board 14, side boards 20 and 22 and back board 24. In the preferred embodiment of the invention, top board 28 is attached to sound board 14, side boards 20 and 22 and back board 24 to further enclose sound box 12. The top board 28 is preferably also substantially flat and rectangular and preferably has a sound port 30 defined therein. Preferably, the sound port is elliptical or circular in shape. The combination of openings 16 and 18 and sound port 30 with the preferred shape of the sound box provides for the generation of musical notes that are comparable to those created by conventional bass instruments.

The components of the sound box are preferably constructed of birch or mahogany wood, although other materials known to be suitable for the construction of musical instruments may also be used, such as, for example, polymeric materials, laminates, other composite or synthetic materials, fiberglass, plexiglass, and the like. If the sound box is comprised of components of polygonal shape, the manufacturing process will be simplified, since the components can be cut from appropriate material using only straight cuts and the joints between the components can therefore be more easily formed. Preferably, the components of the sound box are formed from sheets of wood approximately one-eighth to one-quarter inch thick, although they may be of any convenient thickness. In the preferred embodiment 10 of the invention, sound box 12 is approximately four feet tall, bottom board 26 is approximately 16×12 inches, and top board 28 is approximately 4×8 inches. The sound board is preferably inclined at an angle of approximately 10°, and the sides 20 and 22 are each inclined at an angle of approximately 5°. Of course, the invention may be employed in an instrument of smaller or larger size; however, it is especially suitable for use in instruments having sound boxes comparable in size to those of conventional cellos and basses.

In the preferred embodiment of FIG. 1, back board 24 has an opening (not shown) to provide access to the inside of sound box 12. The opening is normally sealed by a cover 32, which is preferably constructed out of a plastic-type material. In the alternative, cover 32 may be constructed from the same material as the components of the sound box, or other convenient material. The opening in back board 24 is large enough to provide access to the back of the sound board 14 for attachment of neck 34, and is large enough to provide access to the electronics for embodiments of the invention that are equipped for electrical amplification (as discussed in more detail hereinafter). Cover 32 is preferably secured over the opening in the back board by wood screws or other suitable fasteners (not shown).

Attached to the sound board is neck 34. The neck may be adapted from a standard guitar or bass guitar neck, or it may be specially constructed for instrument 10. A standard guitar or bass guitar neck has a typical length within the range of 25.5 to 34 inches. Neck 34 may have one or more frets, and a first fret 36 is illustrated in the drawings. In the alternative, the instrument may be fretless. Neck 34 does not include the headstock that is typical of guitars and other stringed acoustic instruments, but is instead preferably provided with a string attachment that is unique to the invention. In the embodiment of the invention illustrated by FIGS. 1 through 4 and 6, the string attachment comprises a set of pegs 38.

Figure 7:
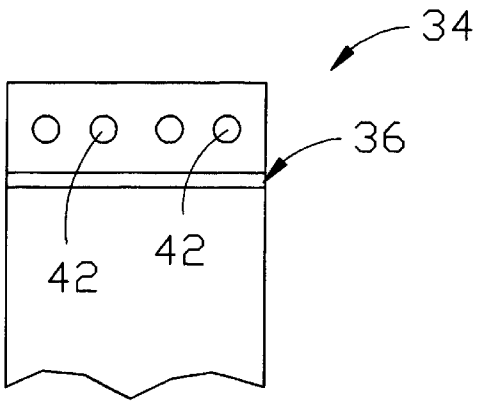
FIG. 7 is an enlarged front view of a portion of the neck of an alternative embodiment of the invention.

One or more strings 40 are provided for instrument 10. These strings are preferably standard bass-type strings that are commercially available from music stores. Generally, strings of this type are provided with a small ring at one end, and this ring (not shown) of string 40 may be easily slipped over one of the pegs 38 for attachment of the string to the neck. An alternative embodiment of the string attachment of the invention is illustrated in FIG. 7, in which a plurality of holes 42 are provided in the neck. The holes are sized so that strings 40 may pass therethrough, but are small enough that the rings on the end of the strings will not pass through but be retained at the back of neck 34.

Figure 6:
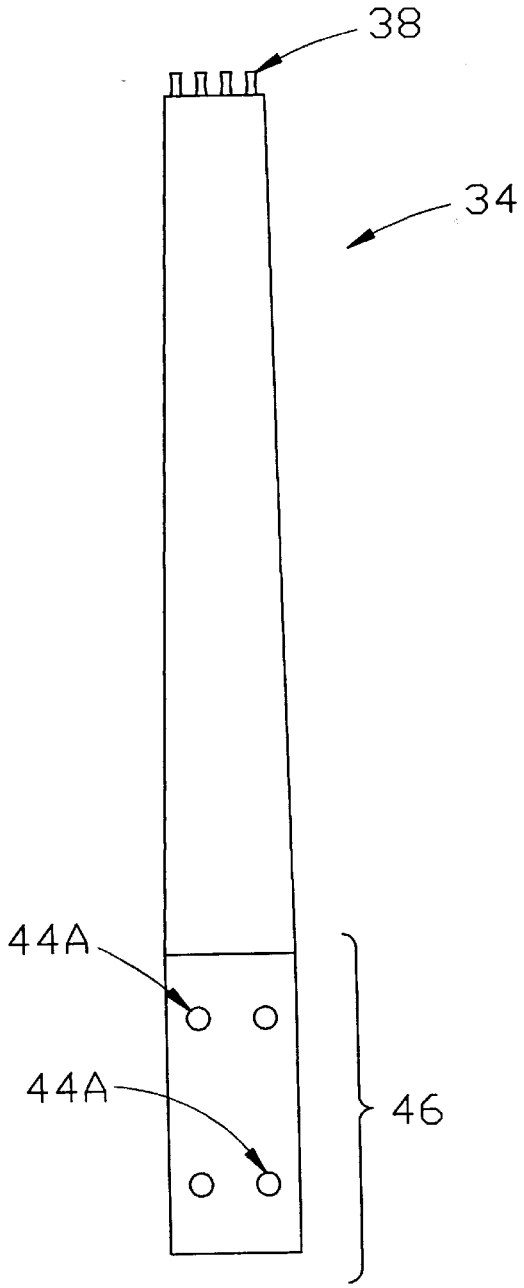
FIG. 6 is an enlarged rear view of the neck of the embodiment of the invention illustrated in FIG. 1.

Neck 34 of instrument 10 includes base portion 46 (see FIG. 6) and fingerboard 48, which is the portion of the neck (visible in FIG. 2) against which the strings lie, and which may contain the frets. An adjustable truss (not shown) may also be provided inside the neck, as is known to those skilled in the art to which the invention relates, to provide a means of adjustment of the bow of the neck, and thereby a means for adjusting the distance of the strings from the fingerboard. As illustrated in the drawings, base portion 46 of neck 34 is fixedly attached to sound board 14 such that a portion of the neck overlaps a portion of the sound board. The attachment of the neck to the sound board must be rigid to counteract the pulling force exerted by strings 40. Accordingly, neck 34 is preferably attached to sound board 14 by several wood screws (not shown) or other fasteners. FIG. 6 illustrates a preferred arrangement of fastener holes 44A in the base portion 46 of neck 34. The neck can be fastened to the sound board in different positions illustrated by alignment holes 44B on the sound board to offer different scale length necks for different musicians, with fastener holes 44A in alignment with either the upper two pairs or the two lower pairs of alignment holes 44B. It is also preferred that sound board 14 be reinforced by neck reinforcement 50 (see FIG. 5) that is disposed inside the sound box underneath the neck.

Figure 5:
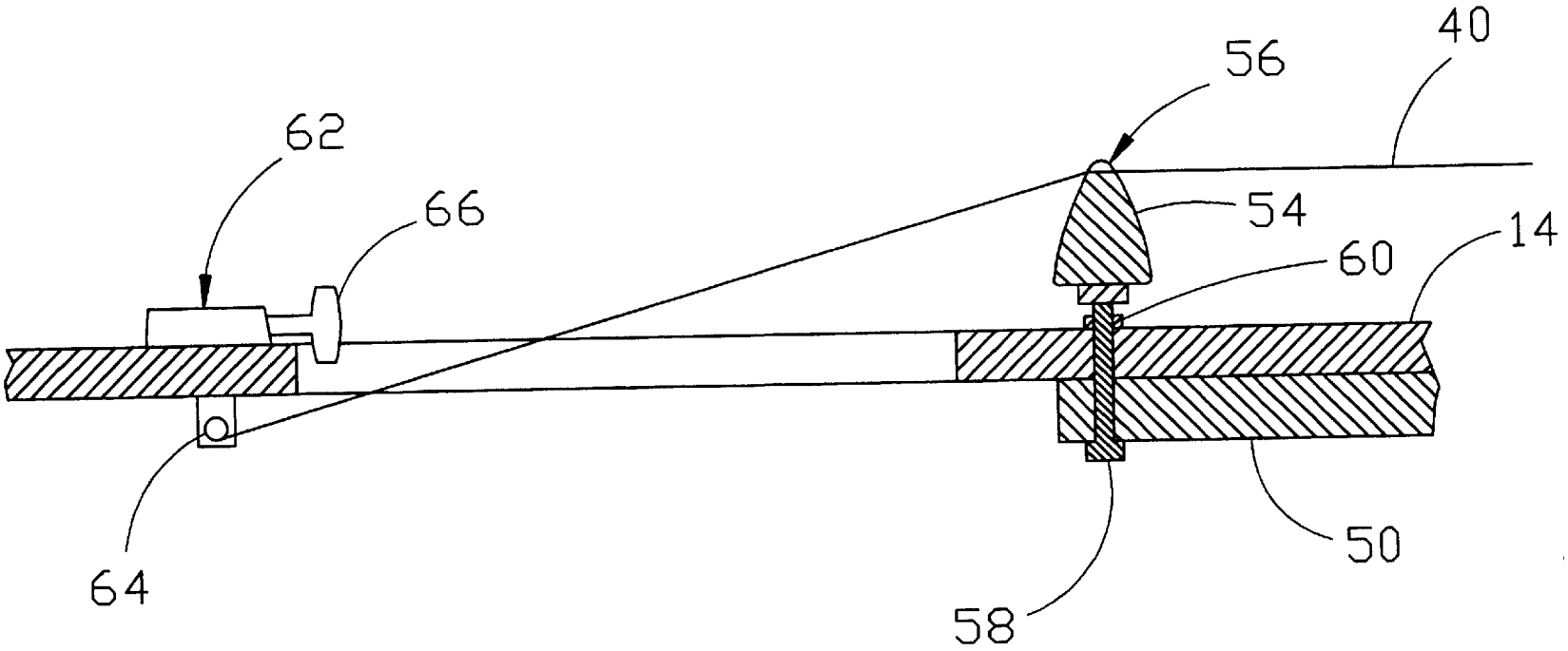
FIG. 5 is a detailed partial sectional view taken along line 5—5 of FIG. 2.

Strings 40 extend only across first opening 16 in the sound board. A pickguard 52 may be located between the point of attachment of neck 34 to sound board 14 and first opening 16. Between first opening 16 and the pickguard, bridge 54 is attached to the sound board. The bridge can be formed out of many different materials such as bone, brass, oak or other convenient material, with an upstanding edge having a set of grooves 56 defined therein. The bridge provides a support surface for and separates the individual strings 40. The bridge is attached to the sound board, and through neck reinforcement 50 by means of a plurality of threaded bolts 58, one of which is shown in FIG. 5, and its associated nut 60. By adjusting the portion of bolts 58 which are threaded into bridge 54, the distance of the bridge from the sound board can be altered so that the distance from the strings to the fingerboard can be adjusted.

A standard set of guitar-type tuning keys 62, are attached to the sound board adjacent to first opening 16. As best shown in FIG. 5, each of the tuning keys has an eyelet 64 for attaching one of strings 40 and a knob 66 for adjustment of the tension on the string. Tuning keys 62 are preferably located at the bottom of first opening 16 on sound board 14 in such position that knobs 66 are directed towards the opening and eyelets 64 are disposed inside sound box 12 adjacent to the first opening. By placing the tuning keys at the end of the strings adjacent the first opening, tuning of the instrument is made easier and more convenient for a musician of small stature. Furthermore, it has been found that the attachment of one end of each of the strings inside the sound box adjacent to the first opening contributes to the quality of the bass tones produced by the instrument. The invention therefore provides an instrument with sound openings 16 and 18 in the sound board and sound port 30 in the top board that emit notes which compare favorably to those generated by conventional acoustic bass instruments.

A hook and loop fastener strip 68 comprising an elongate strip with hook fastening elements on one side and loop fastening elements on the side opposite is preferably wrapped around strings 40 between the bridge and the tuning keys to dampen the vibration of the strings somewhat and prevent any back ringing sound.

The musical instrument of the present invention may be modified to provide for electrical amplification as is known to those skilled in the art. Preferably, pickguard 52 is formed out of a substantially flat piece of plastic that is attached to sound board 14 between the neck and the bridge. The pickguard is preferably sized at one-eighth to one-quarter of an inch in thickness and is capable of supporting a set of pickups 70, a volume knob/pot 72, and an out pot jack 74 for connecting instrument 10 to an amplifier or a public address system (not shown). The pick-ups 70 are adjustable in a manner known to those skilled in the art to which the invention relates in order to optimize the distance between each pick-up and each string 40 of instrument 10. If desired, additional pick-ups and tone controls could also be added.

Figure 9:
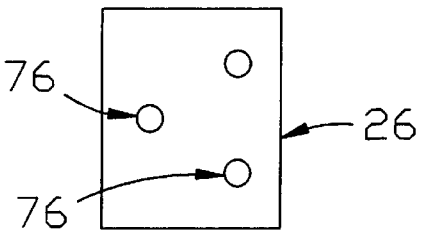
FIG. 9 is a detailed view of the bottom board of the embodiment of the invention illustrated in FIG. 1, showing a preferred location for the adjustable feet thereon.
Figure 8:
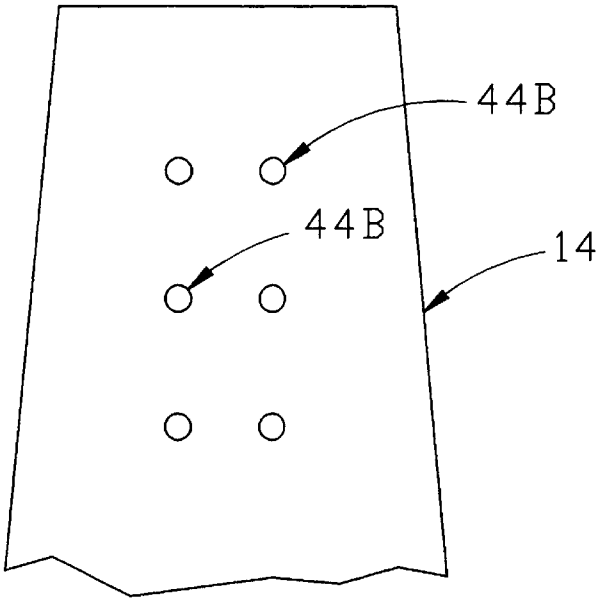
FIG. 8 is a front elevation view of a portion of the sound board of the embodiment of the invention illustrated in FIG. 1.

In a preferred embodiment of the invention, bottom board 26 is provided with a plurality of adjustable feet 76, such as are known in the furniture industry or otherwise to those skilled in the art to which the invention relates, to permit leveling and some height adjustments to be made. FIG. 9 illustrates a preferred arrangement for feet 76, although any convenient arrangement could be employed. In the alternative, bottom board 26 could rest directly on the floor.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A musical instrument, comprising:

a) a hollow sound box having a sound board with a first opening and a second opening, a first side board attached to the sound board, a second side board attached to the sound board and disposed in a spaced relationship with the first side board, a back board connected to the first and second side boards, and a bottom board connected to the sound board, first side board, second side board, and back board;

b) an elongate neck that is attached to the sound board, said neck having a string attachment thereon;

c) a bridge attached to the sound board between the neck and the first sound opening, said bridge having a top edge with a groove defined therein;

d) a tuning key attached to the outside surface of the sound board adjacent to the first sound opening and extending through the sound board to the inside of the sound box; and e) a string having a first end and a second end, the first end of which is attached to the string attachment and the second end of which is attached to the tuning key inside the sound box, with said string extending across the bridge and disposed inside the groove on the bridge.

2. The musical instrument of claim 1 wherein the string is provided at its first end with a ring, and wherein the string attachment is selected from the group consisting of:

(a) a peg around which the ring at the first end of the string may be secured; and (b) a hole into which the string may be placed, which hole is large enough for the string to pass therethrough but small enough that the ring at the first end of the string will not pass therethrough.

3. The musical instrument of claim 1 wherein the sound box is formed out of substantially flat, polygonal boards.

4. The musical instrument of claim 1 wherein the second opening in the sound board is disposed below the first opening.

5. The musical instrument of claim 1 wherein the back board has an opening defined therein.

6. The musical instrument of claim 1 wherein the neck is provided with an adjustable truss.

7. The musical instrument of claim 1 wherein the neck overlaps a portion of the sound board.

8. The musical instrument of claim 7 wherein the amount of the overlap of the neck with the sound board may be varied.

9. The musical instrument of claim 1 wherein the each of the sound board, first side board, second side board, back board and bottom board are substantially flat.

10. The musical instrument of claim 9 wherein the bottom board is provided with a plurality of feet.

11. The musical instrument of claim 9 wherein a substantially flat top board is attached to the sound board, the first side board, the second side board and the back board.

12. The musical instrument of claim 11 wherein the top board is provided with a sound port.

13. The musical instrument of claim 11 wherein the top board is smaller than the bottom board.

14. The musical instrument of claim 1 wherein the neck has a fingerboard with at least one fret disposed thereon.

15. The musical instrument of claim 1 wherein a pickguard is disposed between the neck and the first sound opening.

16. The musical instrument of claim 15 wherein an electrical pickup is attached to the pick guard.

17. The musical instrument of claim 16 wherein an amplifier is connected to the electrical pickup.

18. A musical instrument, comprising:

a) a hollow sound box having a trapezoidal sound board with a first opening and a second opening; a first trapezoidal side board attached to the sound board; a second trapezoidal side board attached to the sound board and disposed in a spaced relationship with the first side board; a trapezoidal back board connected to the first and second side boards; a rectangular bottom board connected to the sound board, first side board, second side board, and back board; and a rectangular top board connected to the sound board, the first side board, the second side board and the back board; the top board having a sound port defined therein and being smaller in area than the bottom board;

b) an elongate neck having a plurality of string attachments and a plurality of frets thereon, said neck being attached to an overlapping a portion of the sound board;

c) an adjustable truss disposed inside the neck;

d) a bridge attached to the sound board between the neck and the first sound opening, the bridge having a top edge with a plurality of grooves defined therein, said grooves being equal in number to the number of the string attachments;

e) a plurality of tuning keys attached to the outside surface of the sound board adjacent to the first sound opening and extending through the sound board to the inside of the sound box, said keys being equal in number to the number of the string attachments; and f) a plurality of strings equal in number to the number of the string attachments, each said string having a first end and a second end, the first end of which is attached to one of the string attachments and the second end of which is attached to one of the tuning keys inside the sound box, wherein each of said strings extends across the bridge and is disposed inside a groove on the bridge.

19. The musical instrument of claim 18 wherein the string is provided at its first end with a ring, and wherein the string attachment is selected from the group consisting of:

(a) a peg around which the ring at the first end of the string may be secured; and (b) a hole into which the string may be placed, which hole is large enough for the string to pass therethrough but small enough that the ring at the first end of the string will not pass therethrough.

20. The musical instrument of claim 18 wherein the first opening in the sound board is elliptical in shape and the second opening is substantially circular and disposed below the first opening.

* * * * *